US005375544A

United States Patent [19]

Badillo

[11] Patent Number: 5,375,544

[45] Date of Patent: Dec. 27, 1994

[54] UNDERCUT AND STRENGTHENED POSTS FOR POLYMERIC BOBBIN BASKET

[75] Inventor: Paul Badillo, Littleton, Colo.

[73] Assignee: Bakron Corporation, Buffalo Grove, Ill.

[21] Appl. No.: 69,454

[22] Filed: Jun. 1, 1993

Related U.S. Application Data

[63] Continuation of Ser. No. 860,988, Mar. 31, 1992, abandoned.

[51] Int. Cl.[5] ..... D05B 57/26

[52] U.S. Cl. ..... 112/231

[58] Field of Search ..... 112/164, 180, 185, 186, 112/188, 196, 189, 192, 228, 231, 232; 180/69.21; 70/240

[56] References Cited

U.S. PATENT DOCUMENTS

| | | | |
|---|---|---|---|
| 1,702,383 | 2/1929 | Hemlets | 112/188 |
| 2,154,403 | 3/1939 | Karle | 112/228 |
| 2,204,991 | 6/1940 | Haltenberger | 180/69.21 |
| 2,219,308 | 10/1940 | Haas | 112/38 |
| 2,344,110 | 3/1944 | Rubel | 112/228 |
| 2,815,822 | 12/1957 | Ramsey | 180/69.21 |
| 3,016,033 | 1/1962 | Herbst | 112/232 |
| 3,347,193 | 10/1967 | Perri | 112/228 |
| 3,698,333 | 10/1972 | Ketterer | 112/189 |
| 4,858,593 | 8/1989 | Badillo | 112/231 |
| 4,970,975 | 11/1990 | Ando et al. | 112/231 X |
| 5,109,783 | 5/1992 | Shimizu | 112/231 |

FOREIGN PATENT DOCUMENTS

| | | | |
|---|---|---|---|
| 1395834 | 3/1965 | France | 112/189 |
| 0091748 | 6/1968 | France | 112/231 |
| 3262180 | 10/1988 | Japan | 112/228 |
| 64-50783 | 3/1989 | Japan . | |
| 0728247 | 4/1955 | United Kingdom | 112/231 |
| 0690087 | 4/1958 | United Kingdom | 112/231 |
| 0872822 | 7/1961 | United Kingdom | 112/231 |

*Primary Examiner*—Clifford D. Crowder
*Assistant Examiner*—Ismael Izaguirré
*Attorney, Agent, or Firm*—Wood, Phillips, VanSanten, Hoffman & Ertel

[57] ABSTRACT

A polymeric bobbin basket having an increased mass with a partial undercut to engage a latching mechanism on a bobbin case. A dissimilar material of greater strength and fatigue resistance than the polymeric material used in the center post is embedded within the interior of the center post less than the full extent of the center post in an arrangement that absorbs vibration and increases the strength and fatigue resistance of the center post. A shoulder spacing between the materials form the undercut.

22 Claims, 4 Drawing Sheets

UNDERCUT AND STRENGTHENED POSTS FOR POLYMERIC BOBBIN BASKET

This application is a continuation, of now abandoned application Ser. No. 07/860,988 filed Jul. 31, 1992.

BACKGROUND OF THE INVENTION

1. Field of the Invention

This invention relates to a bobbin holding means (hereafter referred to as bobbin basket) for use in a rotary loop taker of a lockstitch sewing machine, and specifically to those bobbin baskets that require a bobbin case to retain the bobbin basket from axial movement.

2. Background Art

In further testing of products related to applicant's previous U.S. Pat. No. 4,858,543, dated Aug. 22, 1989, the applicant of the present invention unexpectedly discovered other structural weaknesses which either prohibited use, or severely limited the useful life, of the polymeric bobbin basket for use in a rotary loop taker. In many test cases, the center post head separated from the center post neck or the center post neck separated from the center post stem. The bobbin case moved from its stationary latched-in position and received the full impact of the needle at the needle entry hole causing fracture of the bobbin basket to occur.

Another problem occurs when thread accidentally becomes wedged between the bobbin case lever and the bobbin case locking plate as the needle thread loop passes over and around the bobbin basket as the rotary loop taker rotates. The thread loop tightens around the thin center post neck which severely stresses the center post neck in the direction of the thread loop take up. The lever then pivots from its fulcrum to a partially unlatched position which allows subsequent thread loops to wedge themselves under the bobbin case lever and tighten around the center post neck. Inevitably the center post head fractures at the center post neck or the center post neck fractures at the center post stem.

Another reason for the fracturing of the center post head from the center post neck is the relatively low modulus of polymeric materials relative to the metal materials used in the conventional steel loop taker. A material can endure a finite number of stress cycles. It is a well known fact in material science that metals can endure higher stresses than polymers in like configuration. In other words the fatigue resistance of polymers is lower than that of metals. At higher operating speeds, where vibrational frequency is greatest, the rotary loop taker endures a greater number of stress cycles at higher amplitudes. At lower operating speeds the stress cycles are fewer with lower amplitudes. In a polymeric bobbin basket, the incidence of fracture is dramatically reduced and the duration of useful life is greatly lengthened at lower operating speeds.

It is estimated that perhaps 60% of the world wide lock stitch sewing machines are rated to run above 4500 stitches per minute or 9000 RPM of loop taker rotation. These are considered high operating speeds. A commercially viable polymeric bobbin basket for use in a rotary loop taker must endure the stresses of an industrial sewing operation for about one year. For the reasons given above, it is necessary that the polymeric bobbin basket overcome its inherent weakness in the center post head and neck area in order to achieve side spread usage that realizes the full benefits of non-oiling, better stitch formation and lesser manufacturing costs.

Previous inventors have thought to invent rotary loop takers that outperform and are easier to manufacture than the conventional all steel model. They tried to achieve these objectives by using a synthetic moldable material with lower coefficients of friction. To date, there has not been significant market penetration of rotary loop takers using moldable bobbin baskets of polymeric materials.. It has been the inherent structural weakness of polymeric materials vis a vis metals that has prevented commercial viability of a bobbin basket formed of a synthetic moldable material. Polymeric bobbin baskets require unobvious and novel design to overcome the strength deficiencies relative to conventional metal parts. Violent needle impact and severe fatigue caused by vibration rendered the previous inventions unable to compete with the conventional metal parts in spite of the undeniable advantages of polymeric materials i.e., non-oiling, better stitch formation, less thread breakage.

Haas, U.S. Pat. No. 2,219,308, dated Oct. 29, 1940, developed an oscillating loop taker with a metal insert loop seizing beak to overcome needle deflection of his predominately polymeric shuttle hook. Although he understood that integrating a metal component with a primarily polymeric part would allow his low speed part to at least function, his approach teaches us nothing about how to overcome the structural deficiencies of a polymeric center post relative to its conventional metal counterpart. Haas' invention shows a complete circumferential undercut to define the center post neck, common to all conventional loop takers.

In Badillo's U.S. Pat. No. 4,858,543, dated Aug. 22, 1989, a bobbin basket is described using a metal needle deflection plate to shield the polymeric materials in an inherently vulnerable area was overcome by using metal to shield the weaker polymer below. Badillo clearly understood the necessity of designing around the inherent structural weakness of polymeric materials to solve the problem of severe needle deflection. With that invention, in fact, it became possible to use a polymeric bobbin basket in a mid speed lock stitch sewing machine without external lubrication for a limited length of time. However, Badillo did not realize at that time that the weakness in the center post neck and head portion would be another obstacle to achieving a commercially viable loop taker. Badillo's design shows again a complete circumferential undercut, common to all conventional loop takers. He teaches us nothing in that patent about strengthening or redesigning the center post area.

Herbst, in U.S. Pat. No. 3,016,033, dated Jan. 9, 1962 shows a polymeric oscillating loop taker with an integrally formed center post. It is not known to applicant whether this invention ever came to market. Like Haas, this invention was for a low speed oscillating loop taker and may have been able to endure the stresses and vibrations prevalent at those operating speeds; however it clearly could not withstand the high speeds of today's industrial equipment. Herbst's invention is molded with a complete circumferential undercut, to match exactly the conventional steel bobbin basket. Therefore it teaches nothing about solving the problem of structural weakness inherent in a center post constructed of a polymeric material.

The applicant is not aware of any successful attempts to market a polymeric bobbin basket for use in a rotary loop taker. The applicant discovered in his previous invention covered in U.S. Pat. No. 4,858,543, dated Aug. 22, 1989, the undeniable benefits in sewing performance and manufacturing that a polymeric bobbin basket can provide. The problem remains an inherent weakness in the fatigue strength of a polymer compared to a metal.

SUMMARY OF THE INVENTION

Applicant discovered through intense research that stress to the center post area and more specifically to the area of the center post which is involved in the latching of the bobbin case, cannot endure the stresses of today's industrial sewing operations, especially at higher operating speeds. Applicant discovered a novel resolution to the unobvious problem that could only be defined through rigorous prototype testing; that the center post could only endure the stresses of today's industrial sewing operations by using one of two basic approaches:

1. Additional mass would need to be added to the undercut area of the conventional design in a center configuration so that the center post could increase its fatigue strength and yet allow a secure mode of attachment between the bobbin case and bobbin basket; and 2. A material with stronger fatigue resistance (preferably a metal) would need to be substituted for the polymeric material within the interior of the center stem.

Accordingly, several objects and advantages of my invention are:

1. To provide a polymeric bobbin basket that can endure the stresses of both low speed and high speed sewing operations;

2. To provide a stronger center post that will not fracture or fatigue under severe stress or vibration; and 3. To provide a center post head and neck portion that will allow thread that is accidentally caught between the bobbin case lever and bobbin case sliding locking plate to slide over the center post rather than tighten around the center post neck and possibly cause fracture to occur.

In the preferred embodiment of the invention, the full undercut design of every bobbin basket known to applicant is changed to fill in a portion along the circumference of the undercut. The longer the partial undercut extends, the less the mass of the center post; however the greater the surface area for the latching hole rim to engage. The deeper the undercut towards the interior of the center post, the less the fatigue resistance of the center post; however the greater the surface area for which the latching hole rim to engage.

It is preferable that all sides not carrying the undercut be smoothly curved throughout. The head portion should be rounded at its free end so that thread that accidentally gets wedged between the lever mechanism of the bobbin case and the sliding locking plate slides over the top of the center post and break rather than catching in the undercut and applying a force to the center post. It is preferred to have as small an undercut as possible, and yet one that is large enough to secure the bobbin case in a locked position. The fatigue strength of a material is correlated to the mass of a structure. If a structure has a greater mass relative to another structure, then, all things being equal, the structure having the greater mass will have the higher fatigue strength. This translates into a bobbin basket that can endure a greater number of stress cycles at higher amplitudes than a polymeric bobbin basket of the conventional design. For the different model types utilizing different bobbin cases, the partial undercut must be moved circumferentially relative to the needle entry hole; however, it remains the same relative to the notched cutout on the flange. The length of the partial undercut can be increased if the curvature on the latching hole rim requires a longer surface engaging area; however the longer the partial undercut, the lower the fatigue strength of the center post.

A related embodiment to the partial undercut embodiment above shows a complete 360° undercut having variable depth throughout the undercut. The shallower undercut should be facing away from the latching hole rim that engages the undercut when the bobbin case is latched in the bobbin basket. Since I have shown the benefits that additional mass on a side facing away from the critical latching area of the undercut, a center post could be made to function with a variable depth undercut.

Another embodiment has a metal pin inserted axially into the center post to give the center post more rigidity. Since the modulus of steel is greater than that of polymer, the substitution of the stronger metal for the weaker polymer will further enhance the strength of the center post head. The strength will be enhanced even in the case of a complete circumferential undercut. The metal pin should penetrate approximately ⅓ of the distance of the center post into the interior of the center post. The diameter of the metal pin should be at least 20% of the diameter of the center post.

Another closely related embodiment shows an integrally formed head portion and neck portion, formed of a dissimilar material than the center post (preferably metal) and axially inserted into the interior of the center post. The center post will have enhanced fatigue resistance due to the substitution of the stronger material for the weaker polymer. Even with a complete undercut, a metal insert will endure the stresses of an industrial sewing operation. Like the closely related center pin embodiment above, the metal pin should penetrate approximately ⅓ of the distance of the center post into the interior of the center post. The diameter of the center post neck portion should be at least 20% of the diameter of the center post. Further objects and advantages of this invention will become apparent from a consideration of the drawings and the ensuing description of it.

DETAILED DESCRIPTION OF THE DRAWINGS

Figure 1:
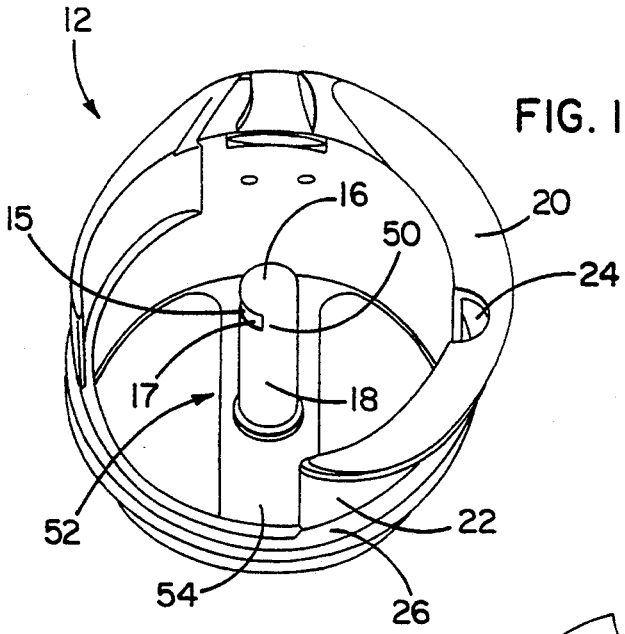
FIG. 1 shows a three quarters perspective view of the inventive bobbin basket.
Figure 2:
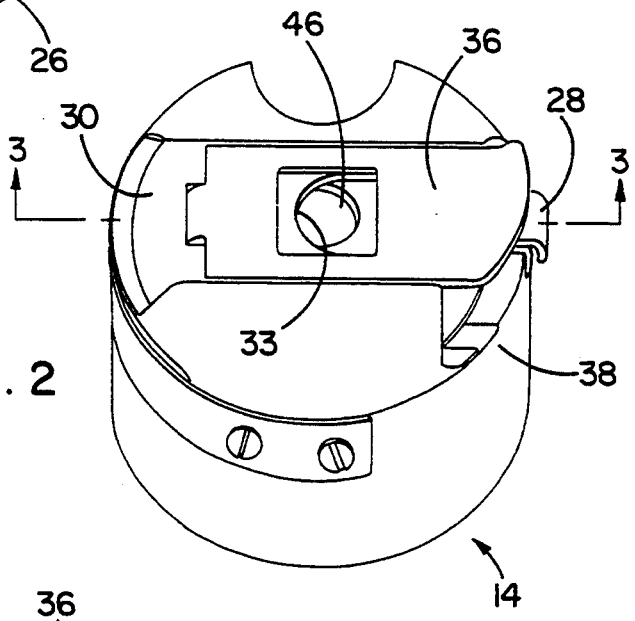
FIG. 2 shows a three quarters perspective view of a bobbin case to cooperate with the bobbin basket of FIG. 1.
Figure 3:
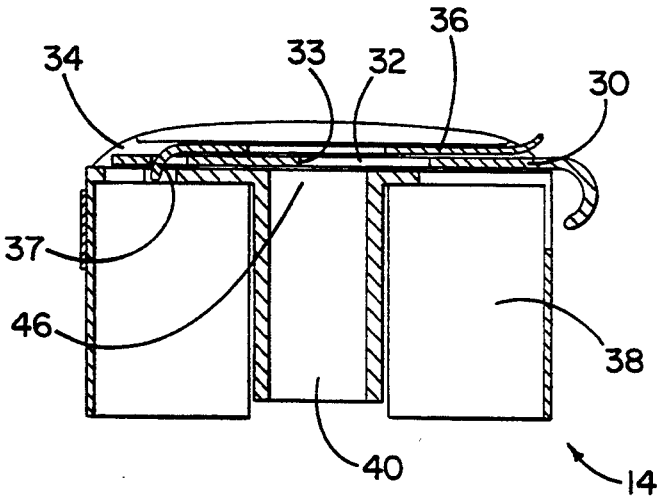
FIG. 3 shows a cross sectional view of the bobbin case taken along line 3—3 of FIG. 2.

FIGS. 1 and 4–10 show a bobbin basket 12 for use with a conventional bobbin case 14, with the bobbin basket 12 having an undercut 15 below a head portion 16 of a center post 18. The undercut 15 is bounded by a non-straight, radially facing edge 11. FIG. 1 clearly shows a flange 20 extending outwards from the top of a cylindrical sidewall 22 of bobbin case 14 and having a notched cutout 24 which extends from flange 20 along cylindrical sidewall 22 to approximately the top of bearing rib 26 of bobbin basket 12. Notched cutout 24 accepts a positioning tab 28, shown in FIG. 2, which is integrally formed on a sliding locking plate 30 of bobbin case 14. Notched cutout 24 is positioned to properly align bobbin case which is referred to in this section. Sliding locking plate 30 has a latching hole 32 located approximately at its mid point and is mounted on a track means 34 integrally formed with the bobbin case 14. A spring-loaded lever assembly 36 is mounted on sliding locking plate 30 on the side opposite positioning tab 28 and moves sliding lock plate 30 forward and backward when a slight force is exerted on the lever 36. The underlying bobbin case shell 38 has an integrally formed cylindrical center post cavity 40 which accepts center post 18 of bobbin basket 12 as bobbin case 14 is loaded. Bobbin 42, shown in FIG. 11, has an aperture 44 at its mid point which fits around the external sidewall of cylindrical center post cavity 40 of bobbin case 14. Cylindrical center post cavity 40 of bobbin case 14 extends completely through the top of bobbin case shell 38 leaving a fixed center post guiding hole 46 for center post 18 to project through. Center post guiding hole 46 and latching hole 32 of sliding locking plate 30 of bobbin case 14 are partially aligned. When lever 36 is toggled open, sliding locking plate 30 slides back relative to notched cutout 24 and causes latching hole 32 on sliding locking plate 30 to align substantially with fixed center post guiding hole 46. When lever 36 is toggled closed (its natural position), sliding locking plate 30 slides forward relative to notched cutout 24 causing the partially aligned holes to overlap. A latching hole rim 33 latches into undercut portion 15 of center post 18. The edge 11 is preferably convex to match the curvature of the rim 33. The latching hole rim 33, which is engaged under center post head portion 16, prevents bobbin case 14 from moving axially outward from center post 18.

Figure 6:
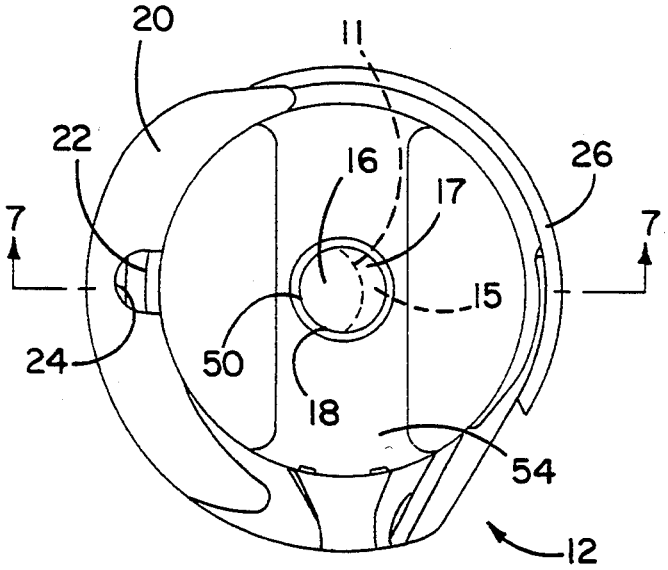
FIG. 6 shows a top view of a modified form of bobbin basket according to the invention.
Figure 7:
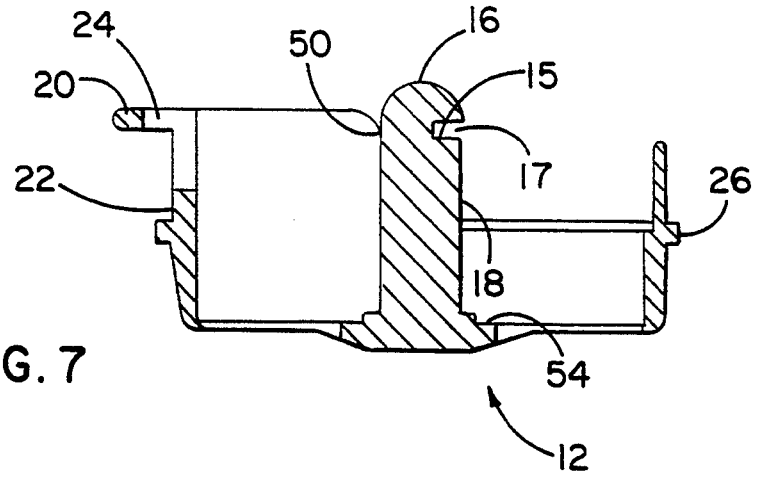
FIG. 7 shows a cross sectional view of the bobbin basket taken along line 7—7 of FIG. 6.

In the preferred embodiment of the invention, best seen in FIGS. 1, 6, and 7, there is a partial undercut 17 of center post 18. Partial undercut 17 defines neck portion 50 of center post 18 of bobbin basket 12 and head portion 16 immediately outwardly adjacent relative to the axis of rotation of the loop taker (not shown). Partial undercut 17 faces the portion of cylindrical sidewall 22 of bobbin basket 12 that is opposite notched cutout 24 on flange 20. Relative to bobbin case 14 in its snapped-in position, as shown in FIG. 1, partial undercut 17 faces a fulcrum 37 of lever assembly 36. partial undercut 17 must be at least as long as necessary to allow latching hole rim 33 of sliding locking plate 30 to engage underneath center post head portion 16 with enough surface area to brake possible axial movement of bobbin basket 12 in severe industrial sewing operations. It is recommended that the circumference of partial undercut 17 extend for at least 90° and be at least about 15% of the diameter of center post 18. A curved center post stem 52 extends from a crosswise support member 54 to the outermost point of head portion 16 on all sides not carrying partial undercut 17. Curved center post stem 52 extends from crosswise support member 54 to the initial portion of partial undercut 17 on all sides carrying partial undercut 17.

Figure 4:
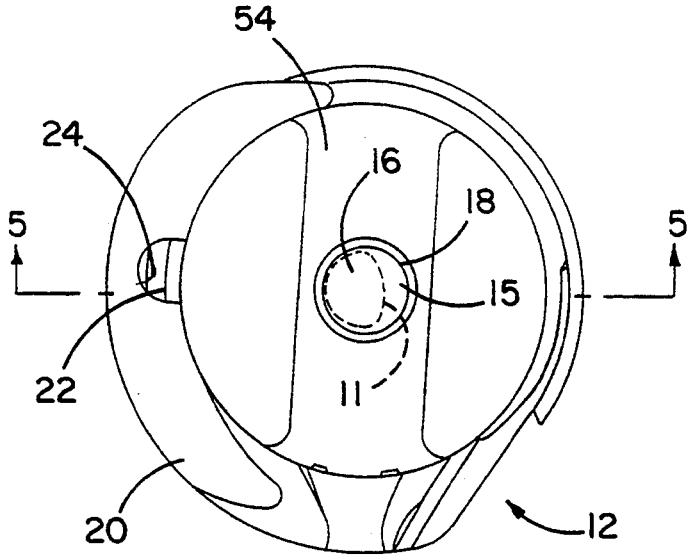
FIG. 4 shows a top view of the inventive bobbin basket having a center post with a full circumferential undercut of varying depth.
Figure 5:
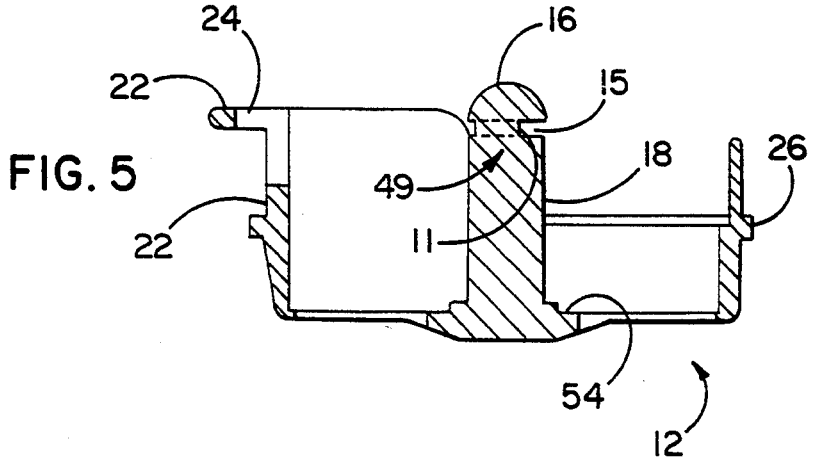
FIG. 5 shows a cross sectional view of the bobbin basket taken along line 5—5 of FIG. 4.

FIGS. 4 and 5 show another embodiment having a full undercut 15 of varying depth throughout the entire circumference of center post 18. Full undercut 15 is deeper on the sides engaging latching hole rim 48. On other sides not engaging latching hole rim 48, full undercut 15 can be of shallower depth to increase the mass of center post 18. In one variation, part of the undercut 15 is filled with a material, after formation of the undercut, as shown at 49 in FIG. 5. The filling material can be the same as the material of the post or a different material.

Figure 8:
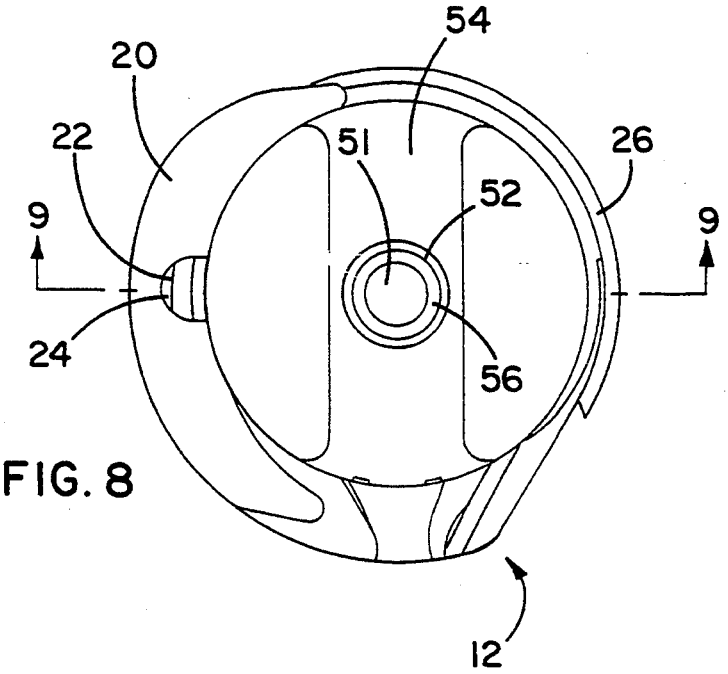
FIG. 8 shows a top view of another modified form of bobbin basket according to the invention.
Figure 9:
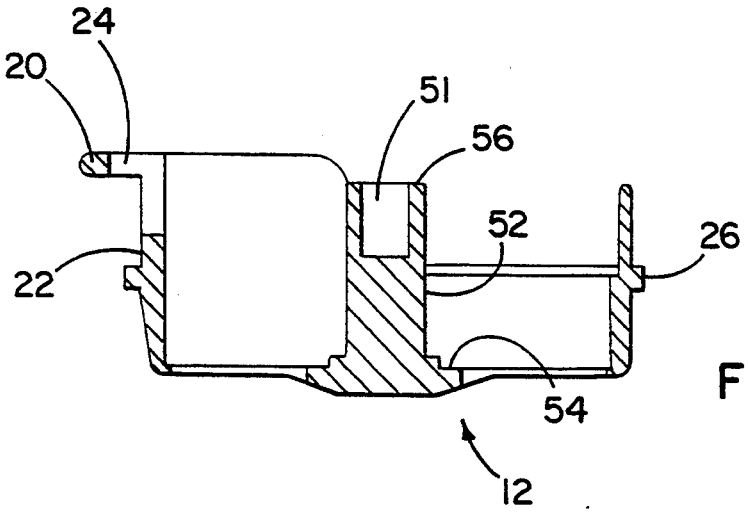
FIG. 9 shows a cross sectional view of the bobbin basket taken along line 9—9 of FIG. 8.
Figure 10:
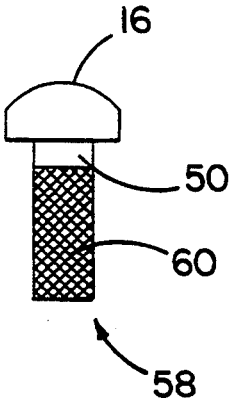
FIG. 10 shows a side elevation view of a reinforcing insert to be used with the bobbin basket of FIG. 9.
Figure 11:
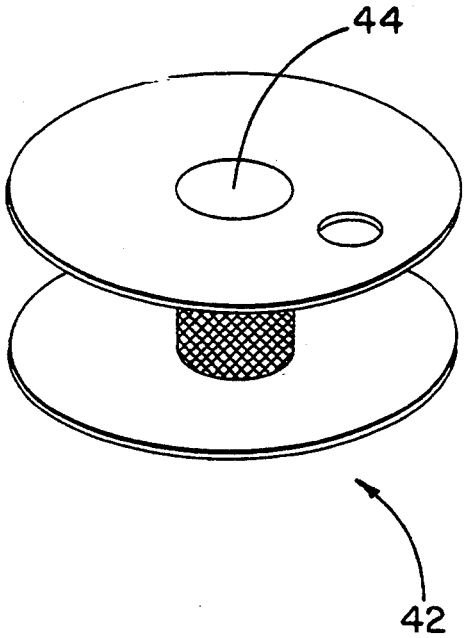
FIG. 11 shows a perspective view of bobbin of the type usable with the present invention.

FIGS. 8, 9 and 10 show yet another embodiment of the invention having center post stem 52 mounted perpendicularly to crosswise support member 54. Center stem 52 extends axially relative to the axis of rotation of the rotary loop taker (not shown). At a predetermined plane perpendicular to the axis of rotation, center stem 52 ends with a generally flat surface area 56. FIG. 10 shows the best view of center post insert 58 having head portion 16 integrally formed with neck portion 50. Neck portion 50 is elongated to anchor deep into the interior of center post stem 52. Threading means 60 can be included on neck portion 50 and/or the interior of center post stem 52. Center post insert 58 can also be insert molded.

SUMMARY, RAMIFICATIONS, AND SCOPE

Accordingly, the reader will see that a means of strengthening the center post is a requirement for a commercially viable rotary loop taker having the undeniable benefits of a polymeric bobbin basket. A polymeric bobbin basket having a means for strengthening the center post of the present invention will enable the rotary loop taker to have the following advantages over the conventional steel part:

- It will eliminate oiling and resulting oil staining on a garment or material being sewn;
- It will eliminate galling or burnout of rotary loop taker raceways;
- It will eliminate raceway wear from rotary loop taker;
- It will drastically reduce thread breakage due to chipping and burring of rotary loop taker raceways;
- It will reduce tensions required to form a stitch thereby drastically reducing puckering;
- It will reduce a thread looping on underside of material; and
- It will be a more cost effective means of manufacturing by saving many polishing and machining operations.

With the present invention, these revolutionary benefits can be made available to the sewing industry. The industry, by this invention, has a cure to many of the most rudimentary problems that have plagued the industry for more than 70 years.

Although the description above contains many specificities, these should not be construed as limiting the scope of the invention but as merely providing illustrations of some of the presently preferred embodiments of this invention. For example the center post can have a cubic rather than a cylindrical configuration. The material could be something other than polymeric.

Thus the scope of the invention should be determined by the appended claims and their legal equivalents, rather than by the examples given above.

What is claimed is:

1. A bobbin basket comprising:

a body defining an axis and a receptacle for a bobbin; and a center post having axially spaced ends, there being a head at one of the center post ends and a radial undercut between the first and second center post ends defining a receptacle for a latching element, said radial undercut having a non-uniform radial depth around the circumference thereof, said radial undercut being bounded by a non-straight, radially facing edge on the post.

2. The bobbin basket according to claim 1 wherein the radial undercut does not extend fully around the circumference of the center post.

3. The bobbin basket according to claim 1 wherein the body of the bobbin basket is made from a polymeric material.

4. The bobbin basket according to claim 1 in combination with a bobbin case having a latching element that is received in the radial undercut on the center post to maintain the bobbin basket and bobbin case in operative relationship.

5. The bobbin basket according to claim 4 wherein the latching element engages the radial undercut at one location on the center post and the center post has no radial undercut at a location diametrically opposite to the one location.

6. The combination according to claim 4 wherein the latching element has a portion in the radial undercut that is matched to the shape of the post edge.

7. The bobbin basket according to claim 1 wherein the post edge has a convex shape.

8. A bobbin basket comprising;

a body defining an axis and a receptacle for a bobbin: and a center post having axially spaced ends, there being a head at one of the center post ends and a radial undercut between the first and second center post ends defining a receptacle for a latching element, said radial undercut having a non-uniform radial depth around the circumference thereof, wherein the center post is made from a first material and a portion of the radial undercut is filled in with a second material.

9. The bobbin basket according to claim 7 wherein the second material is different than the first material.

10. The bobbin basket according to claim 1 wherein the one end of the center post has a smoothly rounded portion defining the head.

11. A bobbin basket comprising:

a body defining an axis and a receptacle for a bobbin; and a center post having axially spaced ends, there being a head at one of the center post ends and a radial undercut between the first and second center post ends defining a receptacle for a latching element said radial undercut having a non-uniform radial depth around the circumference thereof, there being in combination with said bobbin basket a bobbin case having a latching element that is received in the radial undercut on the center post to maintain the bobbin basket and bobbin case in operative relationship, wherein the latching element engages the radial undercut at one location on the center post and the radial undercut in the center post at a second location diametrically opposite to the one location is radially shallower than the radial undercut at the one location.

12. A bobbin basket comprising:

a body defining an axis and a receptacle for a bobbin;

a wall on the body having a surface opening into the bobbin receptacle; and a center post projecting from the wall surface and having first and second axially spaced ends, said center post having a first part made from a first material and an insert within said first part made from a second material, said insert extending less than the full axial extent of the center post from the wall surface, said first center post part defining an axially facing first shoulder, said insert defining a second shoulder facing axially oppositely to the first shoulder, p2 there being a radially opening undercut between the first and second shoulders defining a receptacle for a latching element.

13. The bobbin basket according to claim 10 wherein the insert has an enlarged head defining the first shoulder.

14. The bobbin basket according to claim 10 wherein the first material is a polymeric material and the second material is metal.

15. The bobbin basket according to claim 10 in combination with a bobbin case having a latching element which is received in the radial undercut on the center post with the bobbin basket and bobbin case in operative relationship.

16. The bobbin basket according to claim 10 wherein the center post has an axial length, the insert has an enlarged head and a reduced diameter neck and the insert extends within the first part over at least ¼ of the axial length of the center post.

17. A bobbin basket comprising:

a body defining an axis and a receptacle for a bobbin;

a wall on the body having a surface opening into the bobbin receptacle; and a center post projecting from the wall surface and having first and second axially spaced ends, said center post having first and second parts received one with the other to be in axially overlying relationship, one said first and second center post parts defining a head at the first post end remote from the body wall, one said first and second center post parts being made from metal and extending less than the full axial extent of the center post from the wall surface.

18. The bobbin basket according to claim 15 wherein the head is exposed in both axial and radial directions to guide thread thereover in use.

19. The bobbin basket according to claim 4 where the head has a rounded outer surface that is exposed in both axial and radial directions.

20. The bobbin basket according to claim 3 wherein the one of the first and second center post parts defining the head is made from metal.

21. The bobbin basket according to claim 3 wherein the one of the first and second center post parts that does not define the head is made from polymeric material.

22. The bobbin basket according to claim 3 wherein the bobbin basket body is made from a polymeric material.

* * * * *